US006557749B1

(12) United States Patent
Gill

(10) Patent No.: US 6,557,749 B1
(45) Date of Patent: May 6, 2003

(54) SHEET MATERIAL CONTAINER ERECTABLE FROM PRECURSOR WITH AUTO-FORMING END CLOSURE

(75) Inventor: Walter S. Gill, Columbus, IN (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 10/021,300

(22) Filed: Dec. 19, 2001

(51) Int. Cl.[7] ..... B65D 5/36
(52) U.S. Cl. ..... 229/117; 229/183
(58) Field of Search ..... 229/117, 117.01, 229/183

(56) References Cited

U.S. PATENT DOCUMENTS

| | | | | | |
|---|---|---|---|---|---|
| 2,243,421 | A | | 5/1941 | Himes | |
| 2,284,283 | A | | 5/1942 | Himes | |
| 2,538,860 | A | | 1/1951 | Buttery | |
| 2,659,526 | A | | 11/1953 | Buttery | |
| 2,676,750 | A | * | 4/1954 | Gastright | 229/117 |
| 2,677,495 | A | | 5/1954 | Buttery | |
| 2,943,780 | A | | 7/1960 | Bolding | |
| 2,990,099 | A | | 6/1961 | Ryder | |
| 3,057,535 | A | | 10/1962 | Thompson | |
| 3,767,109 | A | * | 10/1973 | Paige | 229/117 |
| 4,007,869 | A | * | 2/1977 | Stolkin et al. | 229/117 |
| 4,530,460 | A | * | 7/1985 | Hinton | 229/117 |
| 4,895,250 | A | | 1/1990 | Schifrin | |
| 4,976,355 | A | * | 12/1990 | Crutchfield | 229/117 |

* cited by examiner

*Primary Examiner*—Gary E. Elkins
(74) *Attorney, Agent, or Firm*—Banner & Witcoff, Ltd.

(57) ABSTRACT

Exhibiting favorable attributes of both a regular slotted container ("RSC") and an automatic bottom container, a sheet material container is quickly and easily erectable from a knocked-down-flat ("KDF") container precursor. The precursor collapses to a uniform two-layer KDF condition which permits stable, even stacking of multiple precursors for bulk shipping and storage of the same. The precursor is formed from a blank including a plurality of wall panels hingedly attached to each other along fold lines to form a closed loop of wall panels, and a plurality of end flap panels hingedly attached along fold lines to ends of the respective wall panels. A pair of adjacent end flap panels lie in face-to-face relation with each other in the KDF condition. One of the adjacent pairs of panels has a diagonal fold line defining a corner attachment region that attaches to the other end flap panel. As the closed loop of wall panels is erected from the KDF condition to form a rectangular tubular shape, the diagonal fold line and associated attachment of end flap panels cause the end flap panels to pivot inwardly to automatically form an end closure (e.g., bottom) surface of the container.

29 Claims, 4 Drawing Sheets

SHEET MATERIAL CONTAINER ERECTABLE FROM PRECURSOR WITH AUTO-FORMING END CLOSURE

BACKGROUND OF THE INVENTION

The present invention relates to containers formed of sheet material, and more particularly to containers that are instantly manually erectable by an end user from a stackable container precursor.

A regular slotted container ("RSC") is a conventional and widely used type of rectangular shipping container which is formed-up from a knocked-down-flat ("KDF") container precursor having four wall panels, four top flap panels and four bottom flap panels. The KDF container precursor is formed by securing together edges of a blank including the aforementioned panels to form an endless loop. In the KDF state, a RSC precursor has a substantially uniform, two-layer thickness, with the top and bottom flaps extending outward from, and coplanar with, their associated wall panels. The uniform two-layer thickness permits the RSC precursors to be stacked in an even, space efficient manner, for bulk shipping and/or storage of the same.

A RSC is typically formed by an end user pressing on opposing edges (the folding scores) of the KDF precursor. The opposed forces cause the precursor to open into a rectangular tubular shape, by way of rotations of the wall panels about their hinged connections to each other. Next, each of the four bottom flaps is manually pivoted inwardly to a position generally orthogonal with respect to the tubular rectangular structure. Typically, a pair of opposing minor bottom flaps are first pivoted inwardly, then the remaining pair of opposing major bottom flaps are manually pivoted inwardly over the minor flaps and are affixed to each other with tape or the like. Once the desired contents are loaded into the container, the four top flap panels are pivoted inwardly in a similar fashion, to form a top closure of the container.

Due to their simple construction, RSCs are economical to manufacture and, in general, serve well their intended purpose. In their collapsed state, RSCs can be easily and stably stacked for bulk shipping and storage. At their point of use, RSCs may readily be set-up, loaded and sealed by an end user. As mentioned, however, set-up of the boxes requires multiple steps. In particular, formation of a RSC requires that a user manually pivot inwardly each of the bottom flaps into a bottom-forming position. While holding the bottom flaps in position, the user must affix the flaps with adhesive tape or the like. Thus, set-up of a RSC requires time and effort on the part of the end user to manually position and affix the bottom flaps.

In comparison to RSCs, automatic bottom containers are known which are designed to simplify the box set-up procedure. Exemplary of known automatic bottom containers is Thompson U.S. Pat. No. 3,057,535. The container of Thompson is erected by separating opposing side walls to thereby cause bottom flaps, which are adhesively bonded together and sandwiched between opposing side walls, to automatically pivot outwardly to an interlocking, bottom forming position.

The Thompson container blank has four side wall panels and four bottom flaps connected thereto. Two of the bottom flaps have a flap extension with adhesive on an interior surface. A container precursor is made by folding the bottom flaps inward to double-back on an inside surface of a respective side wall, folding the flap extensions to double-back again, and then folding over the side walls to connect lateral edges of the blank to thereby form an endless loop of adjoined panels. The flap extensions bond to exterior surfaces of the adjacent bottom flaps as the side walls are folded over onto each other and connected. Each of the bottom flaps, and doubled-back flap extensions, are sandwiched between the side walls, thereby creating up to five-layers of thickness in the regions of the flap extensions.

As compared to RSCs, automatic bottom containers, such as disclosed by Thompson, require additional manufacturing steps for forming the relatively complicated arrangement of bottom flaps. In general, this leads to a lower overall rate of production. For example, multiple passes of a blank through a forming machine may be required to apply glue, and provide folds, in all the necessary places.

A further drawback of known automatic bottom containers is that the container precursors do not lie uniformly flat. The collapsed, automatic bottom container precursors vary in thickness from, e.g., five-layers to two-layers. When stacking precursors of such irregular thickness, bulges form, e.g., at the five-layer thickness regions, and slope off in surrounding directions toward the areas having lesser numbers of layers. When such precursors are stacked, the bulges may cause the precursors to sit unstably, and the stack to unstably tilt. Varying the placement of the varying thicknesses within a stack, by rotating or otherwise shifting the precursors relative to each other, may tend to stabilize the stack, but such special positioning adds to the costs of packaging the precursors for distribution to end users.

A further drawback of known automatic bottom containers is that, once set-up, the bottom surface of the container is not uniformly planar and uninterrupted. For example, with reference to the Thompson design, the flap extensions are bonded to exterior container surfaces, thereby creating protruding edges on the exterior bottom surface of the container, which may tend to catch or snag on supporting surfaces.

Accordingly, a sheet material container that would form-up more rapidly and with less manual effort than a RSC, and which could be manufactured more economically than known automatic bottom containers, would be highly desirable.

SUMMARY OF THE INVENTION

In view of the foregoing, it is a principal object of the present invention to provide a sheet material container (and precursor/blank therefor) with a configuration of end flap panels that causes the panels to automatically pivot into a container closure (e.g., bottom) forming position upon erecting the container precursor from a KDF condition.

It is a more specific object of the present invention to provide a container as aforesaid, which may be manufactured largely in the manner of a RSC, with minor modifications to existing machinery used to manufacture RSCs.

It is a related object of the present invention to provide a container precursor as aforesaid, that has a substantially uniform two-layer thickness in a KDF condition, thereby permitting even and stable stacking of the precursors for bulk shipping and storage.

The foregoing and other objects are achieved, in whole or in part, by the various aspects of the present invention. In a first aspect, the present invention is embodied in a sheet material container precursor. Therein, a plurality of wall panels of sheet material are hingedly connected to each other along respective fold lines to form a closed loop of wall panels that may be collapsed to a two layer knocked-down-flat condition and erected to form a rectangular tubular shape. A plurality of end flap panels of sheet material are hingedly attached to, and depend from, ends of respective ones of the plurality of wall panels. A pair of adjacent ones of the end flap panels, which lie in face-to-face relation in the two layer knocked-down-flat condition, and which extend orthogonally to each other in the rectangular tubular shape, have inside surfaces attached to each other to thereby form a corner attachment. One of the pair of end flap panels comprises a diagonal fold line adjacent the corner attachment. When the closed loop of wall panels is erected from the two layer knocked-down-flat condition to form the rectangular tubular shape, the corner attachment causes: (1) the one end flap panel to pivot inwardly about its hinged attachment to a respective wall panel; (2) a first corner region of the one end flap panel to fold back upon an outside surface of the one end flap panel, about the diagonal fold line; and (3) the other of the pair of end flap panels to pivot inwardly about its hinged attachment to a respective wall panel. Thereby, the pair of end flap panels are moved toward respective end closure forming positions in which the pair of end flap panels partially overlap with each other and extend inwardly with respect to the wall panels.

In a second aspect, the invention is embodied in a container formed-up from a sheet material container precursor as aforesaid. The plurality of wall panels of sheet material are erected to form the rectangular tubular shape. The plurality of end flap panels extend inwardly with respect to the rectangular tubular shape, to form a closed end of the rectangular tubular shape. The corner region of the one end flap panel is folded back upon an outside surface of the one end flap panel to form three overlaid panel portions at a position corresponding to the corner attachment.

In a third aspect, the invention is embodied in a blank of sheet material for forming a collapsible container. The blank includes a plurality of wall panels of sheet material which are hingedly connected to each other along respective fold lines. End ones of the plurality of wall panels are connectible to each other to form a closed loop of wall panels that may be collapsed to a two-layer knocked-down-flat condition, and erected to form a rectangular tubular shape. A plurality of end flap panels of sheet material are hingedly attached to, and depend from, ends of respective ones of the plurality of wall panels. A pair of adjacent ones of the plurality of end flap panels are foldable onto each other about one of the respective fold lines hingedly connecting a corresponding pair of the plurality of wall panels, such that respective corner forming side and end edges of said pair of end flap panels extend along one another. One of the pair of end flap panels comprises a diagonal fold line which extends from the side edge of the one end flap panel to the end edge of the one end flap panel. The diagonal fold line defines a first corner region which, when the pair of end flap panels are folded onto each other, substantially overlies a corresponding region of the other of the pair of end flap panels. A second corner region of the one end flap panel, opposite the first corner region, is cut-away from a third one of the plurality of end flap panels such that, when the pair of end flap panels are folded onto each other, a portion of the other of the pair of end flap panels, extending between the one end flap panel and the third end flap panel, remains uncovered by the one end flap panel.

These and other aspects and features of the invention will be readily apparent and fully understood from the following detailed description of the preferred embodiments, taken in connection with the accompanying drawings.

DETAILED DESCRIPTION OF THE PREFERRED EMBODIMENTS

Figure 1:
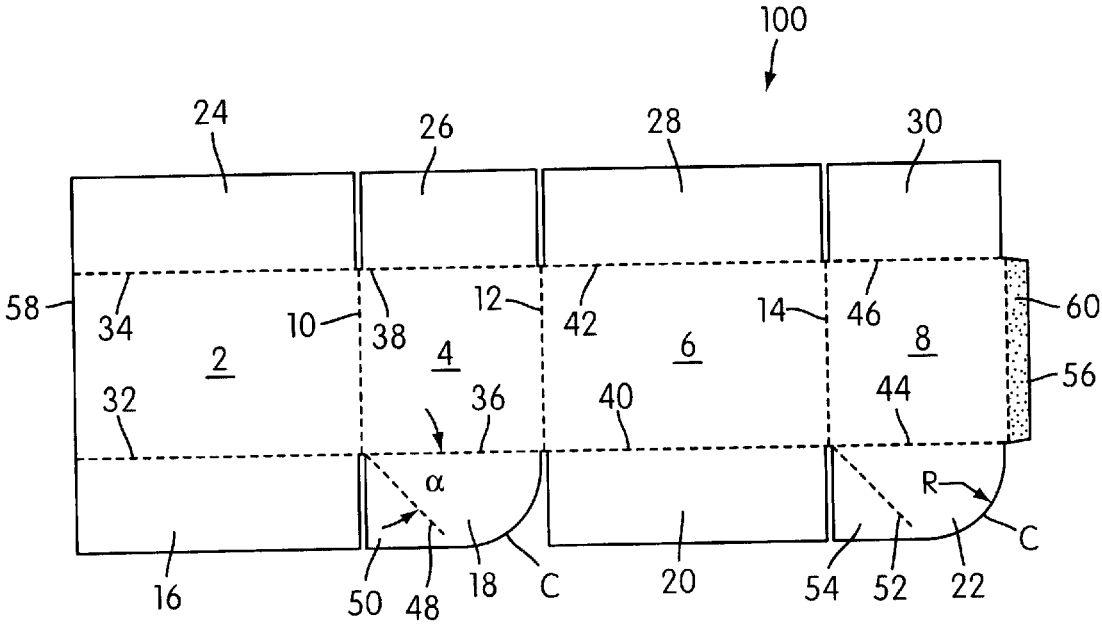
FIG. 1 is a plan view of a blank of sheet material according to the invention, showing surfaces that will form an outside of a container according to the present invention.

Referring to FIG. 1, a container blank 100 in accordance with the invention comprises a plurality of sidewall panels 2, 4, 6, and 8 hingedly connected to each other along respective fold lines 10, 12 and 14. Blank 100 further includes a plurality of bottom-closure forming end flap panels 16, 18, 20, and 22, and a plurality of top-closure forming end flap panels 24, 26, 28, and 30. These end flap panels are hingedly attached to opposite ends of respective ones of sidewall panels 2, 4, 6 and 8, along fold lines 32, 36, 46 and 44 and fold lines 32, 36, 40 and 44. The bottom-closure forming end flap panels and the top forming end flap panels are, with the exception of a cut-away corner region to be described, separated by slots in the manner of a conventional regular slotted container ("RSC"). Blank 100 may be formed from die-cut corrugated fiberboard or other known sheet material, e.g., corrugated plastic, cardboard, etc. The fold lines may be formed in a known manner, such as by scoring or perforating the sheet material.

Figure 3:
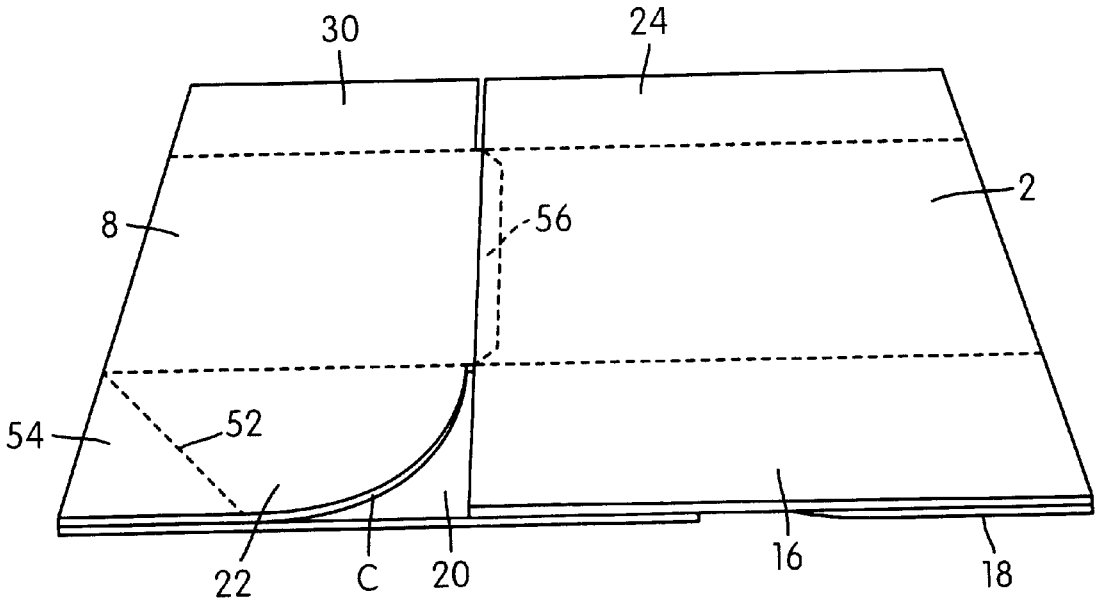
FIG. 3 is a perspective view of a tubular container precursor formed from the blank of FIGS. 1 and 2, collapsed to a two-layer knocked-down-flat ("KDF") condition.
Figure 4:
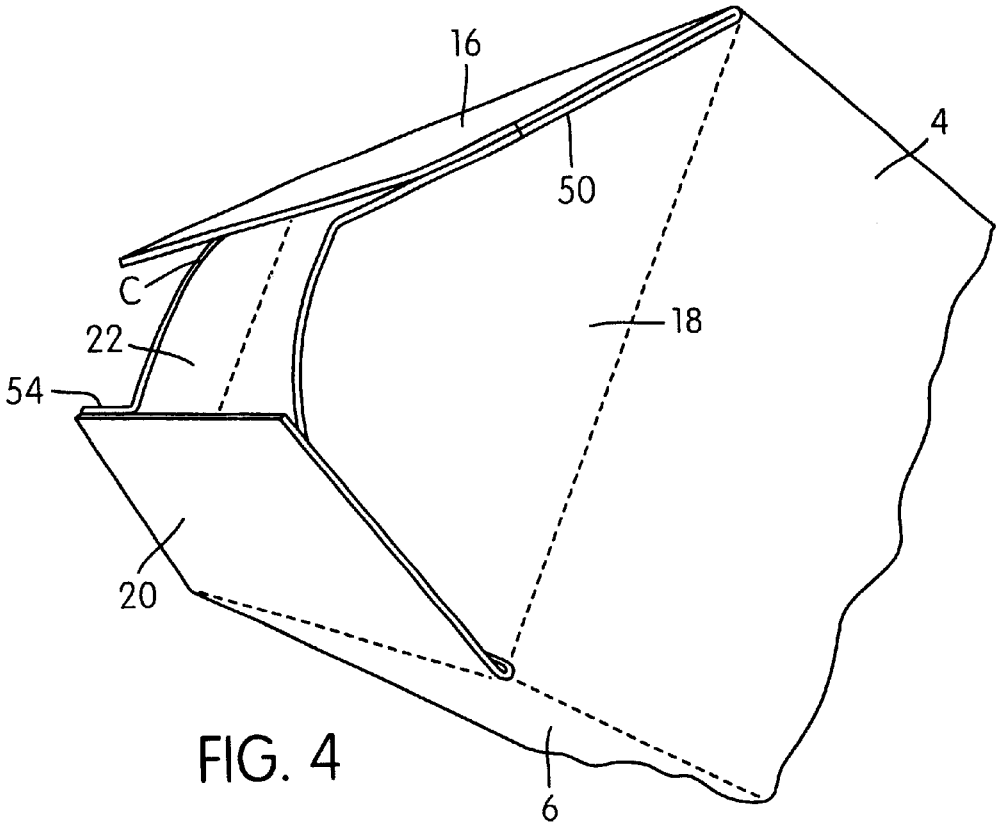
FIG. 4 is a partial perspective view of the tubular precursor shown in FIG. 3, part-way through a container set-up process.

A tab 60 depending from a lateral side of wall panel 8 permits the lateral edge of wall panel 8 to be connected to the lateral edge of wall panel 2, to thereby form a closed loop of wall panels that may be collapsed to a two-layer knocked-down-flat ("KDF") condition (see FIG. 3), and erected to form a rectangular tubular shape (see FIG. 4). In the KDF condition shown in FIG. 3, it is seen that bottom-closure forming end flap panels 20 (major) and 22 (minor) are folded onto each other in face-to-face relation, as are bottom-forming end flap panel pair 16 (major), 18 (minor). In this condition, corner-forming side and end edges of end flap panels 20 and 22 extend along one another, as do corner-forming side and end edges of flap panel pair 16, 18.

Figure 2:
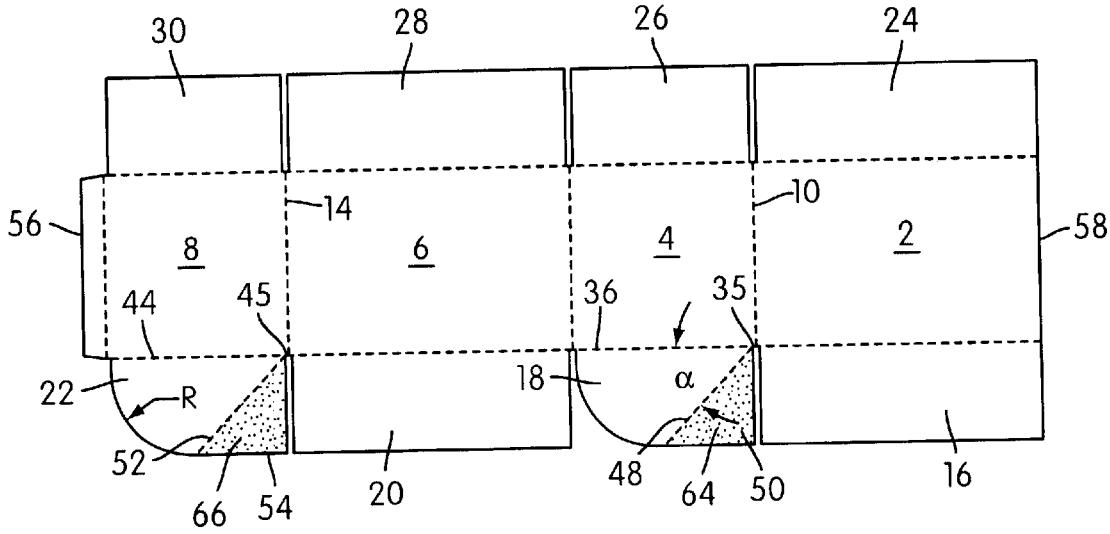
FIG. 2 is a plan view of the blank of FIG. 1, showing an opposite surface thereof that will form an inside of the container.

As seen in FIGS. 1 and 2, each of end flap panels 18 and 22 includes a diagonal fold line 48, 52 which extends from a side edge of the panel to the end edge of the panel, to thereby define a triangular corner region 50, 54. When end flap panels 16 and 18 are folded onto each other, triangular corner region 50 overlies a corresponding region of end flap panel 16. Likewise, when end flap panels 20 and 22 are folded onto each other, triangular corner region 54 overlies a corresponding region of end flap panel 20.

End flap panel 22 has a second corner region, opposite triangular corner region 54, which is cut-away such that, upon formation of the closed loop of wall panels, the edge thereof flares away from an adjacent side edge of major flap panel 16 (moving outwardly from fold line 36). As such, and as seen in FIG. 3, a portion of major end panel 20 remains uncovered by minor end flap panel 22 upon formation of the container precursor and placement of the same in the KDF condition. Likewise, minor end flap panel 18 has a cut-away second corner region, opposite triangular corner region 50, providing an edge that flares away from a side edge of major flap panel 20. As such, a corresponding portion of major end flap panel 16 remains uncovered by minor end flap panel 18 with the precursor in the KDF condition. These cut-away corner regions of the minor end flap panels serve to avoid interference between adjacent edges of the minor and major end flap panels during the container set-up process, as will be explained.

As shown, in the preferred embodiment, the cut-away corner regions form a convex arcuate edge of the respective end flap panel. The edge extends from the hinge line 36, 44 attaching the respective end flap panel 18, 22 to a respective wall panel 4, 8, to a portion of the end edge of the respective end flap panel 18, 22 that extends substantially parallel to the respective hinge line 36, 44.

As seen in FIG. 2, triangular corner regions 50, 54 have adhesive applied to surfaces thereof that will become inside surfaces of the rectangular tubular shape. The adhesive permits attachment of corner regions 50, 54 to corresponding regions of the respective panels 16, 20 when the pairs of panels 16, 50 and 20, 54 are folded upon each other in formation of the closed loop of wall panels. The adhesive need not be provided across the entire surface area of the triangular corner region as shown, but rather could be provided on a small subpart of the triangular region. Also, the adhesive could be provided on the mating surface of major flap panels 16, 20, instead of within the corner regions 50, 54. Obviously, the corner attachments may be effected by means other than adhesive as well, such as by stapling or stitching.

In the illustrated preferred embodiments, diagonal fold lines 48, 52 extend at an angle $\alpha$ of about 45° with respect to the adjacent fold lines 36, 44. The diagonal fold lines may be formed as lines of perforations, scoring or the like. Different types of scores can be used depending on the competing concerns of degree of ease in opening the box and structural strength, and also the board grade used for the blank material.

The folding-over of blank 100 about hinge line 12, securement of tab 56 to the lateral edge of wall panel 2, and attachment of corner regions 50, 54 to adjacent end flap panels 16, 20, forms a container precursor according to the invention, as shown in FIG. 3. The KDF closed loop of wall panels 2, 4, 6, 8 shown in FIG. 3 may be erected to a rectangular tubular shape by pressing inwardly on opposed lateral edges of the precursor, similar to a RSC. However, unlike a RSC, the attachment of corner region 50 to adjacent end flap panels 16 causes minor flap panel 18 to simultaneously pivot inwardly about its hinged attachment to wall panel 4. At the same time, triangular corner region 50 is caused to fold back onto an outside surface of the remaining portion of minor flap panel 18, about diagonal fold line 48; major flap panel 16 (which is attached on its inside surface to corner region 50) is caused to pivot inwardly about its hinged attachment to corresponding wall panel 2. In this manner, end flap panels 16, 18 are moved toward respective end (e.g., bottom) closure forming positions, in which these panels partially overlap with each other and extend inwardly (generally orthogonally in the illustrated embodiment) with respect to wall panels 2, 4, 6, 8. By virtue of the like attachment of bottom forming end flap panels 20, 22 to each other, a like movement of end flap panels 20, 22 simultaneously occurs upon erection of the container precursor from the KDF condition to the rectangular tubular shape.

As the container precursor is being opened by an end user, minor flap panels 18, 22 will begin to impact against the adjacent major flap panels 16, 20. The cut-away corner regions of minor end flap panels 18, 22 lessen this impact and thereby facilitate opening of the precursor into a container. An edge having a convex curvature with a radius of about 5" has been found to provide a desirable angle of impact that (1) does not inhibit the opening of the container, and (2) provides a degree of friction to hold the carton open during loading or taping. Obviously, cut-away regions providing edge contours other than as shown could be used.

Figure 5:
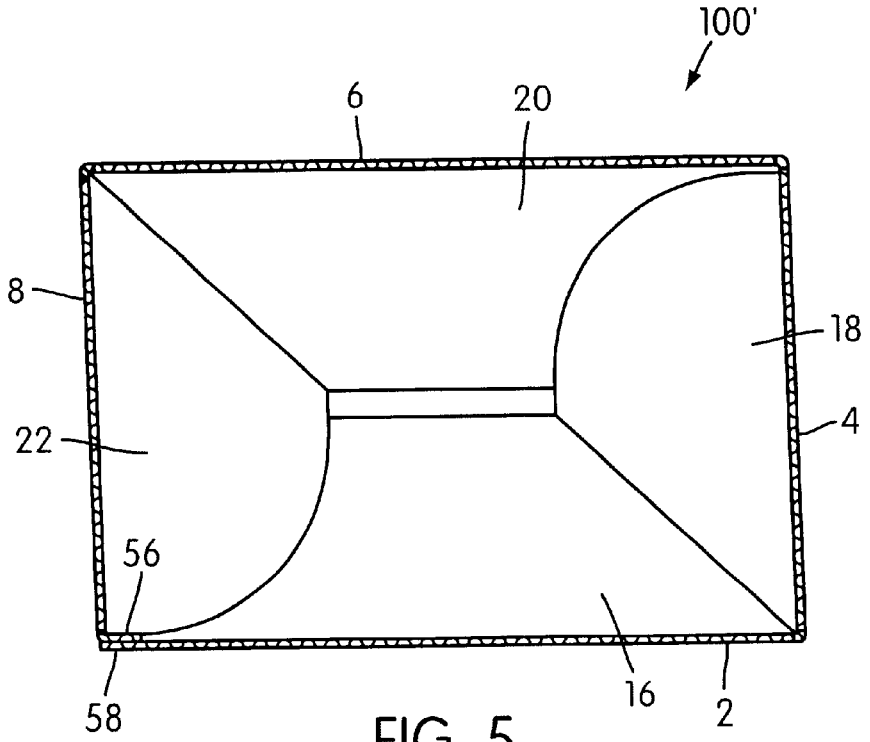
FIG. 5 is a top plan view of the precursor of FIGS. 3 and 4, substantially formed-up into a container, with end flap panels thereof pivoted to a position substantially orthogonal to the sidewall panels to form an end closure (e.g., bottom) of the container.
Figure 6:
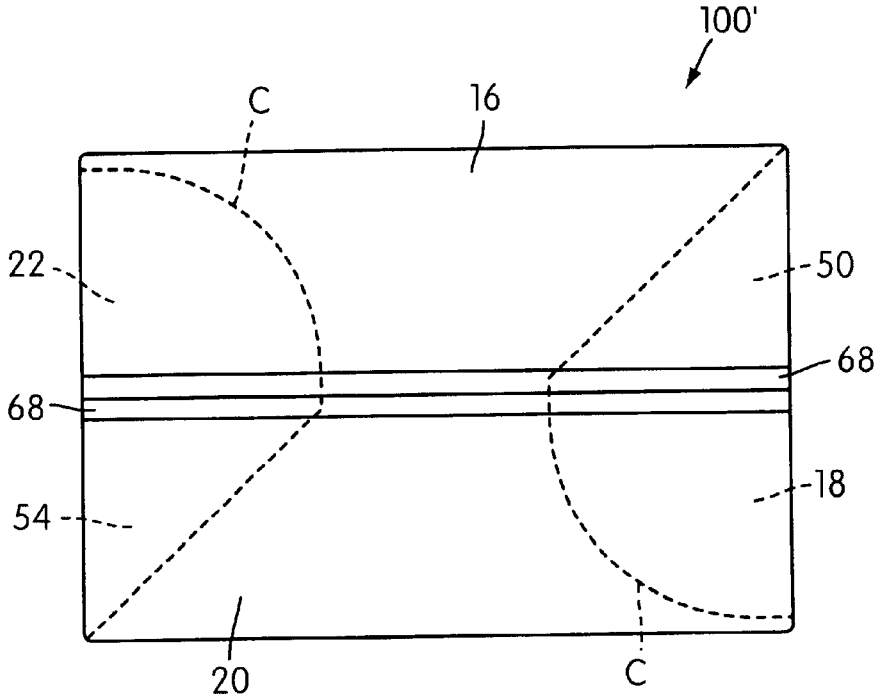
FIG. 6 is a bottom plan view of the container of FIG. 5, showing the container bottom completely formed and the major end flap panels affixed to each other with adhesive tape.

In FIG. 4, the conversion of the container precursor from its KDF condition to a rectangular tubular shape has progressed substantially, and an inward rotation of bottom-forming end flap panels 16, 18, 20, 22 is underway. In FIG. 5, the rectangular tubular shape of the container is fully formed, and end flap panels 16, 18, 20 and 22 have substantially reached their final closure-forming positions orthogonal to wall panels 2, 4, 6, 8. All that remains to complete the container is for panels 16, 20 to be pressed down slightly and taped (as depicted in FIG. 6), or otherwise secured in place.

Notably, the doubled-back triangular attachment regions 50, 54 are wholly covered in the completed container—on their outsides by major flap panels 16, 20 and on their insides by the remaining portions of minor flap panels 18, 22. The resultant outside bottom surface is visually and functionally indistinguishable from that of a RSC. The inside bottom surface differs only in that the minor panels 18, 22 have a smaller (and differently shaped) footprint, as a result of the cut-aways and doubled-back portions. Advantageously, an automatic end closure forming structure is provided with a container precursor that collapses, like a RSC, to a KDF condition providing a uniform two-layer thickness. This uniform thickness permits even, stable stacking of bulk quantities of precursors, for storage and shipping of the same. Also, like a RSC, the formed-up container has a substantially planar exterior bottom surface formed by a pair of adjoined bottom flap panels, rather than an irregular bottom surface (as provided by known automatic bottom containers) with edges that may be prone to catch on a supporting surface.

While providing significant functional advantages over the industry standard RSC, the present invention also avoids the added costs associated with known automatic bottom container designs. Container precursors in accordance with the present invention can be easily manufactured with slight modifications to existing machines presently utilized to make RSC precursors. Such machines include a common type of machine, available from many different manufacturers and generically referred to as a flexo-folder-gluer machine, equipped with a die cut section. The two primary modifications are: (1) the addition of a slide bar that will position two glue heads over the surface of the blank that will become the inside surface of the precursor/container; and (2) the mounting of motion sensitive electronic eyes to the glue heads, to stop and start the flow of glue as needed. The diagonal fold lines and cutaway may be placed in each of the end flap panels using the die-cut section. The cut-away corner regions of the minor end flap panels may also be formed in the die cutting process using the same die-cut section.

With the modified machine, glue is preferably applied in two areas in a single pass. In an exemplary process, major bottom flap panel 16 will have glue applied in a region that will mate with the corner attachment region 54 of the second (minor) flap panel. Minor bottom flap 22 will have glue applied in its corner attachment region for mating with a corresponding surface area of major flap panel 20. In contrast, known automatic bottom box designs typically require two or more passes of the blank through the forming machinery to apply adhesive and provide folds in all the necessary places.

Through use of existing equipment used to manufacture RSC precursors, precursors according to the present invention can be produced with only slightly increased machine set-up time. Production may approach that obtainable in the manufacture of conventional RSC precursors. Additionally, the production can be carried out with no added square footage requirements.

Figure 7:
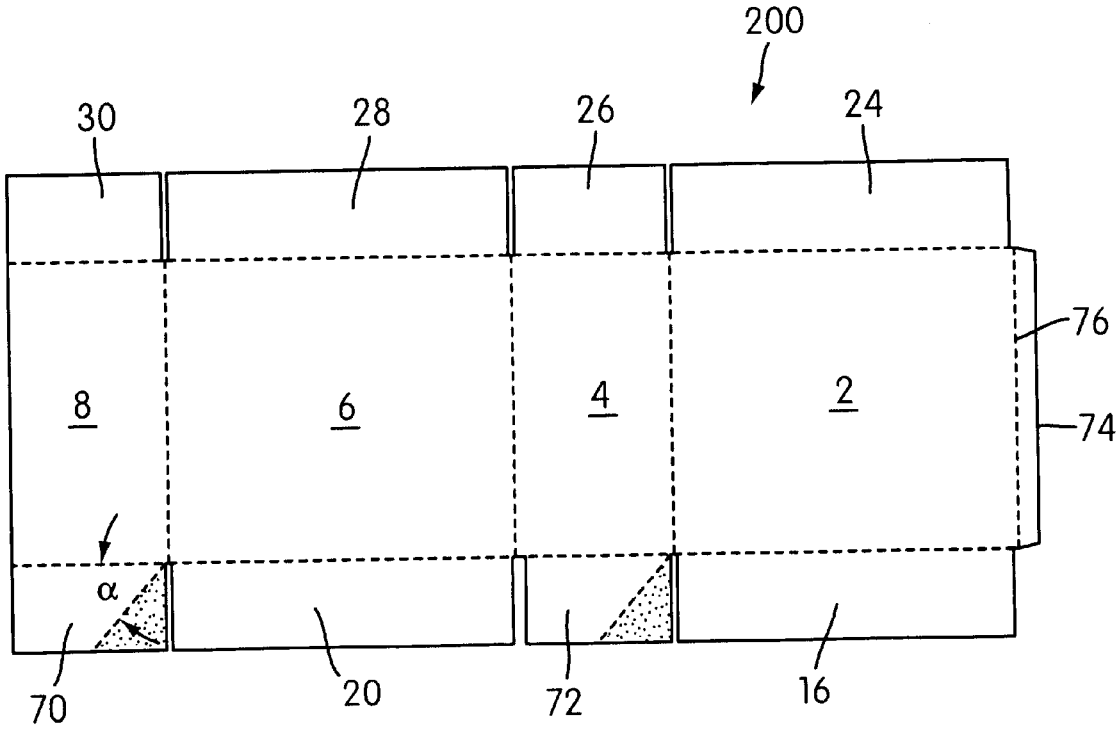
FIG. 7 is a plan view of an alternative blank of sheet material in accordance with the invention, showing surfaces that will form an outside of a container in accordance with the present invention.

FIG. 7 shows an alternative sheet material blank 200 which omits the cut-away corner portions of the end flap panels 18, 22 included in the previous embodiment of FIGS. 1–6. A precursor may be formed, and a container erected, from blank 200 in substantially the same manner as the first embodiment. Lacking the cut-away corner regions, major flap panels 16 and 20 may interfere slightly with adjacent corners of minor flap panels 70 and 72, as the precursor is formed-up into a container.

It will be appreciated that the invention is not limited to the particular types of containers illustrated, and may be embodied in a variety of container styles and sizes, including containers having wall panels and end flap panels of differing lateral and longitudinal dimensions, and/or a greater or smaller number of wall panels and end flap panels.

It will be appreciated that the diagonal fold lines and associated corner attachment regions may be provided on major rather than minor end flap panels, as may the interference reducing cut-away corner regions. Although the illustrated corner attachment regions are triangular—defined, in part, by the linear end and side edges of the end flap panels meeting at a right angle, obviously the corner attachment regions may be of other shapes, as dictated by the end flaps edge profiles, and the paths of the diagonal fold lines, each of which may be varied from the configuration shown.

While in the illustrated preferred embodiments, the major and minor end flap panels are dimensioned to extend an equal distance away from their hinged attachments to respective wall panels, this is not necessarily so. Instead, e.g., the end panel provided with the corner attachment region (the minor flap panel in the preferred embodiment) could have a lesser extension than the other, such that the attachment to the other panel is made in a region of the other panel spaced inwardly from its end edge, rather than in a corresponding corner region of the other panel.

The present invention has been described in terms of preferred and exemplary embodiments thereof. Numerous other embodiments, modifications and variations within the scope and spirit of the appended claims will occur to persons of ordinary skill in the art, from a review of this disclosure.

What is claimed is:

1. A sheet material container precursor, comprising:

a plurality of wall panels of sheet material which are hingedly connected to each other along respective fold lines to form a closed loop of wall panels that may be collapsed to a two layer knocked-down-flat condition and erected to form a rectangular tubular shape; and a plurality of end flap panels of sheet material, each being hingedly attached to and depending from an end of a respective one of said plurality of wall panels;

wherein:

a pair of adjacent ones of said end flap panels, which lie in face-to-face relation in said two layer knocked-down-flat condition, and which extend orthogonally to each other in said rectangular tubular shape, have inside surfaces attached to each other to thereby form a corner attachment;

one of said pair of end flap panels comprises a diagonal fold line adjacent said corner attachment;

when the closed loop of wall panels is erected from said two layer knocked-down-flat condition to form said rectangular tubular shape, said corner attachment causes: (1) said one end flap panel to pivot inwardly about its hinged attachment to a respective wall panel; (2) a first corner region of said one end flap panel to fold back upon an outside surface of said one end flap panel, about said diagonal fold line; and (3) the other of said pair of end flap panels to pivot inwardly about its hinged attachment to a respective wall panel; whereby, said pair of end flap panels are moved toward respective end closure forming positions in which said pair of end flap panels partially overlap with each other and extend inwardly with respect to said wall panels.

2. The sheet material container precursor according to claim 1, wherein a second corner region of said one end flap panel is cut-away from a third one of said plurality of end flap panels to prevent interference between said one end flap panel and said third end flap panel as the closed loop of wall panels is erected to the rectangular tubular shape.

3. The sheet material container precursor according to claim 2, wherein said second corner region forms an arcuate edge of said one end flap panel.

4. The sheet material container precursor according to claim 3, wherein said arcuate edge is a convex edge extending from a point adjacent a hinge line attaching said one end flap panel to a respective one of said plurality of wall panels, to an end edge of said one end flap panel that extends substantially parallel to said hinge line.

5. The sheet material container precursor according to claim 1, wherein said first corner region is triangular in shape.

6. The sheet material container precursor according to claim 1, said diagonal fold line extending from a point along a side edge of said one end flap panel adjacent a hinge line attaching said one end flap panel to a respective one of said plurality of wall panels, to an end edge of said one end flap panel that extends substantially parallel to said hinge line.

7. The sheet material container precursor according to claim 1, wherein said diagonal fold line comprises a line of spaced perforations formed in said sheet material.

8. The sheet material container precursor according to claim 1, wherein said corner attachment comprises an adhesive attachment of said inside surfaces to each other.

9. The sheet material container precursor according to claim 1, further comprising a second plurality of end flap panels of sheet material, each being hingedly attached to and depending from a second end of a respective one of said plurality of wall panels, for forming a second container end closure.

10. The sheet material container precursor according to claim 1, wherein:

a second pair of adjacent ones of said plurality of end flap panels, which lie in face-to-face relation in the two layer knocked-down-flat condition, and which extend orthogonally to each other in the rectangular tubular shape, have inside surfaces attached to each other at corner regions thereof to thereby form a second corner attachment;

one of said second pair of end flap panels having a second diagonal fold line adjacent said second corner attachment;

when the closed loop of wall panels is erected from the two layer knocked-down-flat condition to form the rectangular tubular shape, said second corner attachment causes: (1) said one end flap panel of said second pair of end flap panels to pivot inwardly about its hinged attachment to a respective wall panel; (2) a first corner region of said one end flap panel of said second pair of end flap panels to fold back upon an outside surface of said one end flap panel of said second pair, about said second diagonal fold line; and (3) the other of said second pair of end flap panels to pivot inwardly about its hinged attachment to a respective wall panel; whereby, said second pair of end flap panels are moved toward respective end closure forming positions in which said second pair of end flap panels partially overlap with each other and extend inwardly with respect to said wall panels.

11. The sheet material container precursor according to claim 10, wherein a second corner region of said one end flap panel is cut-away from a third one of said plurality of end flap panels to prevent interference between said one end flap panel and said third end flap panel as the closed loop of wall panels is erected to the rectangular tubular shape.

12. The sheet material container precursor according to claim 11, wherein a second corner region of said one of said second pair of end panels is cut-away from the other of said pair of end flap panels to prevent interference between said one of said second pair of end flap panels and the other of said pair of end flap panels, as said closed loop of wall panels is erected to said rectangular tubular shape.

13. The sheet material container precursor according to claim 12, wherein said second corner region forms an arcuate edge of said one of said second pair of end flap panels.

14. The sheet material container precursor according to claim 13, wherein said arcuate edge is a convex edge extending from a hinge line attaching said one of said second pair of end flap panels to a respective one of said plurality of wall panels, to an end edge of said one of said second pair of end flap panels that extends substantially parallel to said hinge line.

15. The sheet material container precursor according to claim 10, wherein said second corner region is triangular in shape.

16. The sheet material container precursor according to claim 10, said diagonal fold line extending from a point along a side edge of said one end flap panel adjacent a hinge line attaching said one end flap panel to a respective one of said first plurality of wall panels, to an end edge of said one of said second pair of end flap panels extending substantially parallel to said hinge line.

17. The sheet material container precursor according to claim 16, said second diagonal fold line extending from a point along a side edge of said one of said second pair of end flap panels adjacent a second hinge line attaching said one of said second pair of end flap panels to a respective one of said plurality of wall panels, to an end edge of said one of said second plurality of end flap panels extending substantially parallel to said second hinge line.

18. The sheet material container precursor according to claim 10, further comprising a second plurality of end flap panels of sheet material, each being hingedly attached to and depending from a second end of a respective one of said plurality of wall panels, for forming a second container end closure.

19. A container formed-up from the sheet material container precursor according to claim 10, wherein:

said plurality of wall panels of sheet material are erected to form said rectangular tubular shape;

said plurality of end flap panels extend generally orthogonally with respect to said rectangular tubular shape to form a closed end of said rectangular tubular shape; and said corner region of said one of said pair of end flap panels is folded back upon an outside surface of said one end flap panel to form three overlaid panel portions at a position corresponding to said corner attachment; and said corner region of said one of said second pair of end flap panels is folded back upon an outside surface of said one end flap panel of said second pair of end flap panels to form three overlaid panel portions at a position corresponding to said corner region attachment of said second pair of end flap panels.

20. A container formed-up from the sheet material container precursor according to claim 1, wherein:

said plurality of wall panels of sheet material are erected to form said rectangular tubular shape;

said plurality of end flap panels extend inwardly with respect to said rectangular tubular shape, to form a closed end of said rectangular tubular shape; and said corner region of said one end flap panel is folded back upon an outside surface of said one end flap panel to form three overlaid panel portions at a position corresponding to said corner attachment.

21. The container according to claim 20, further comprising securing means for securing said plurality of wall panels in said rectangular tubular shape, and said plurality of end flap panels extending generally orthogonally with respect to said rectangular tubular shape.

22. The container according to claim 21, wherein said securing means comprises a strip of adhesive tape extending over adjacent end edges of opposite ones of said plurality of end flap panels.

23. The container according to claim 20, further comprising a second plurality of end flap panels of sheet material, each being hingedly attached to and depending from a second end of a respective one of said plurality of wall panels, for forming a second container end closure.

24. A blank of sheet material for forming a collapsible container, comprising:

a plurality of wall panels of sheet material which are hingedly connected to each other along respective fold lines, end ones of said plurality of wall panels being connectible to each other to form a closed loop of wall panels that may be collapsed to a two-layer knocked-down-flat condition and erected to form a rectangular tubular shape; and a plurality of end flap panels of sheet material, each being hingedly attached to and depending from an end of a respective one of said plurality of wall panels;

wherein:

a pair of adjacent ones of said plurality of end flap panels are foldable onto each other about one of said respective fold lines hingedly connecting a corresponding pair of said plurality of wall panels, such that respective corner forming side and end edges of said pair of end flap panels extend along one another;

one of said pair of end flap panels comprises a diagonal fold line which extends from the side edge of said one end flap panel to the end edge of said one end flap panel, said diagonal fold line defining a first corner region which, when said pair of end flap panels are folded onto each other, substantially overlies a corresponding region of the other of said pair of end flap panels; and a second corner region of said one end flap panel, opposite said first corner region, is cut-away from a third one of said plurality of end flap panels such that, when said pair of end flap panels are folded onto each other, a portion of the other of said pair of end flap panels, extending between said one end flap panel and said third end flap panel, remains uncovered by said one end flap panel.

25. The blank of sheet material according to claim 24, wherein a layer of adhesive is applied to said first corner region, for permitting attachment of said first corner region to said corresponding region of the other of said pair of end flap panels, when said pair of end flap panels are folded upon each other.

26. The blank of sheet material according to claim 24, wherein the second corner region forms an arcuate edge of said one end flap panel.

27. The blank of sheet material according to claim 26, wherein said arcuate edge is a convex edge extending from a hinge line attaching said one end flap panel to a respective one of said plurality of wall panels, to a portion of said end edge thereof that extends substantially parallel to said hinge line.

28. The blank of sheet material according to claim 24, wherein said first corner region is triangular in shape.

29. The blank of sheet material according to claim 24, wherein:

a second pair of adjacent ones of said plurality of end flap panels, including said third end flap panel and a fourth end flap panel, are foldable onto each other about a second one of said respective fold lines hingedly connecting a corresponding pair of said plurality of wall panels, such that respective corner forming side and end edges of said second pair of end flap panels extend along one another;

said fourth end flap panel comprises a second diagonal fold line which extends from the side edge of said fourth end flap panel to the end edge thereof, said second diagonal fold line defining a first corner region of said fourth end flap panel which, when said second pair of end flap panels are folded onto each other, substantially overlies a corresponding corner region of the third end flap panel; and a second corner region of said fourth end flap panel, opposite said first corner region thereof, is cut-away from said one end flap panel such that, when said second pair of end flap panels are folded onto each other, a portion of the third end flap panel, corresponding to said second corner region of the fourth end flap panel, remains uncovered by said fourth end flap panel.

* * * * *